US005522671A

United States Patent [19]

Keesling

[11] Patent Number: 5,522,671

[45] Date of Patent: Jun. 4, 1996

[54] HYDRAULIC BOAT LIFT

[76] Inventor: Klinton H. Keesling, 615 Dupont St., Punta Gorda, Fla. 33951

[21] Appl. No.: 422,825

[22] Filed: Apr. 17, 1995

[51] Int. Cl.[6] ..... B63C 3/06

[52] U.S. Cl. ..... 405/3

[58] Field of Search ..... 405/3; 114/44, 114/45, 48

[56] References Cited

U.S. PATENT DOCUMENTS 5,378,082 1/1995 Hiller et al. ..... 405/3

*Primary Examiner*—William P. Neuder
*Attorney, Agent, or Firm*—Frank A. Lukasik

[57] ABSTRACT

The invention is a hydraulic boat lift having improved, reinforced concrete pilings, wherein the lift operates with static cables and moving blocks (sheaves) guided by grooves formed in the prestressed, concrete piles. Hydraulic cylinders are fastened to the top of a first pair of piles, An extra heavy block is affixed to each of the hydraulic cylinders and the blocks are adapted to run in the grooves. Stainless strand core cables are affixed to the tops of a first pair of piles, and run through pipes molded in the piles and through blocks affixed to lifting brackets. Lifting brackets are affixed to a first end of structural tubing. A second set of cables are affixed to the top of the first pair of piles, run through a second set of pipes molded in the piles, through the lifting means, to a second pair of piles. A hydraulic system powers the lift.

2 Claims, 3 Drawing Sheets

HYDRAULIC BOAT LIFT

RELATED APPLICATION

This application incorporates by reference related application entitled PRESTRESSED CONCRETE PILING, Ser. No. 08/422,885, filed Apr. 17, 1995 by the instant inventor.

BACKGROUND OF THE INVENTION

1. Field of the Invention

The invention relates generally to a hydraulic boat lift having improved reinforced concrete pilings and more particularly to a hydraulic boat lift mounted on reinforced concrete pilings wherein the lift operates with static cables and moving sheaves guided by grooves formed in the prestressed concrete pilings.

2. Discussion of the Prior Art

A variety of boat lifts or hoists are known. Heretofore, one such hoist involved a pair of davits which were secured to a dock or sea wall, and which extended out over the water. Block and tackle arrangements were carried by the end of the davits which, in turn, were connected to the bow and stern of the boat. Other boat lifting devices were known in which the above-described block and tackle arrangements were replaced by a horizontal pipe journaled on the ends of the davits, with a pair of cables, attached to the pipe at each end thereof proximate the davits, and with the cables being connected to the bow and stern of the boat. Upon rotation of the journaled pipe, as by means of a large hand wheel affixed to one end thereof, the pipe served as a winch which would uniformly raise or lower both ends of the boat substantially simultaneously.

Other boat dock and lift apparatus were known in which an upright frame was provided adjacent the water, with the frame secured to a dock or sea wall. One such device is shown in U.S. Pat. No. 4,432,664 to Baldyga which discloses a boat hoist which comprises a column, a tubular hoist sliding vertically on the column, a boat cradle on the hoist, shore reinforcement means to anchor an upper part of the column to the shore, and a power unit connecting the column and hoist. A hydraulic cylinder rests on a bottom closure plate and the cylinder contains a piston rod and serves to lift the hoist when hydraulic pressure is applied.

U.S. Pat. No. 4,509,446 to Sutton discloses a drydocking device having a moment resisting arrangement and a submersible pontoon having a first side positioned adjacent to a single fixed structure and having an arrangement for selectively introducing air or water into at least one chamber within the pontoon for raising and lowering the pontoons.

U.S. Pat. No. 4,641,596 to Reprogel et al discloses an upright frame having a pair of spaced upright members and a horizontal cross member. A lift is mounted on the frame. The lift has a support engageable with a boat hull and a pair of generally vertical arms movably mounted on the frame uprights. A compound pulley and cable arrangement is mounted on the horizontal cross members of the frame. This pulley and cable arrangement includes a first pulley block stationary with respect to the frame, and a second pulley block movable horizontally along the cross member. A first cable is secured to the frame, is entrained around certain of the pulleys on the first and second pulley block, and is secured to one of the lift uprights. A second cable is also secured to the frame, entrained around others of the pulleys on the first and second pulley blocks, and is secured to the other lift upright. A hydraulic cylinder is secured between the frame and the movable pulley block such that upon actuation of the hydraulic cylinder, horizontal movement of the second pulley block is effected along the cross member forward and away from the first pulley block to take up or let out the cables, and to move both of the lift upright members an equal distance in vertical direction along the frame uprights so as to ensure that the lift support and a boat supported thereon remain in generally horizontal position as the lift is raised and lowered.

U.S. Pat. No. 4,773,346 to Blanding et al discloses a hydraulic boat lift for lifting small boats upwardly out of a body of water simultaneously supplying water pressure to four support posts connected to four corner portions of a lifting frame. Each of the corner posts comprises a hydraulic cylinder body connected to the lift and moveable vertically on its downwardly extending piston rod which forms support legs for the lift.

U.S. Pat. No. 5,090,841 to Penick et al discloses a boat lift in which a hydraulic pump and cylinder with a piston is mounted on a manual boat lift so that the piston rod carries a pulley which engages the lifting cable so that when the piston moves in the cylinder, the boat will move up or down.

SUMMARY OF THE INVENTION

This invention is a hydraulic boat lift operating with static cables and moving sheaves. The cables and pulleys are arranged in such a way as to allow a 2:1 ratio between the cradle (lifting beam) and the hydraulic ram (sheave) motion. The arrangement also allows for the lifting mechanism (hydraulic ram) to be on one side of the lift bent. The lifting mechanism operates with 10,000 psi hydraulics. The boat lift is guided by grooves formed in prestressed concrete pilings which serve as guides for cradles in their range of motion.

DESCRIPTION OF THE PREFERRED EMBODIMENTS

Figure 1:
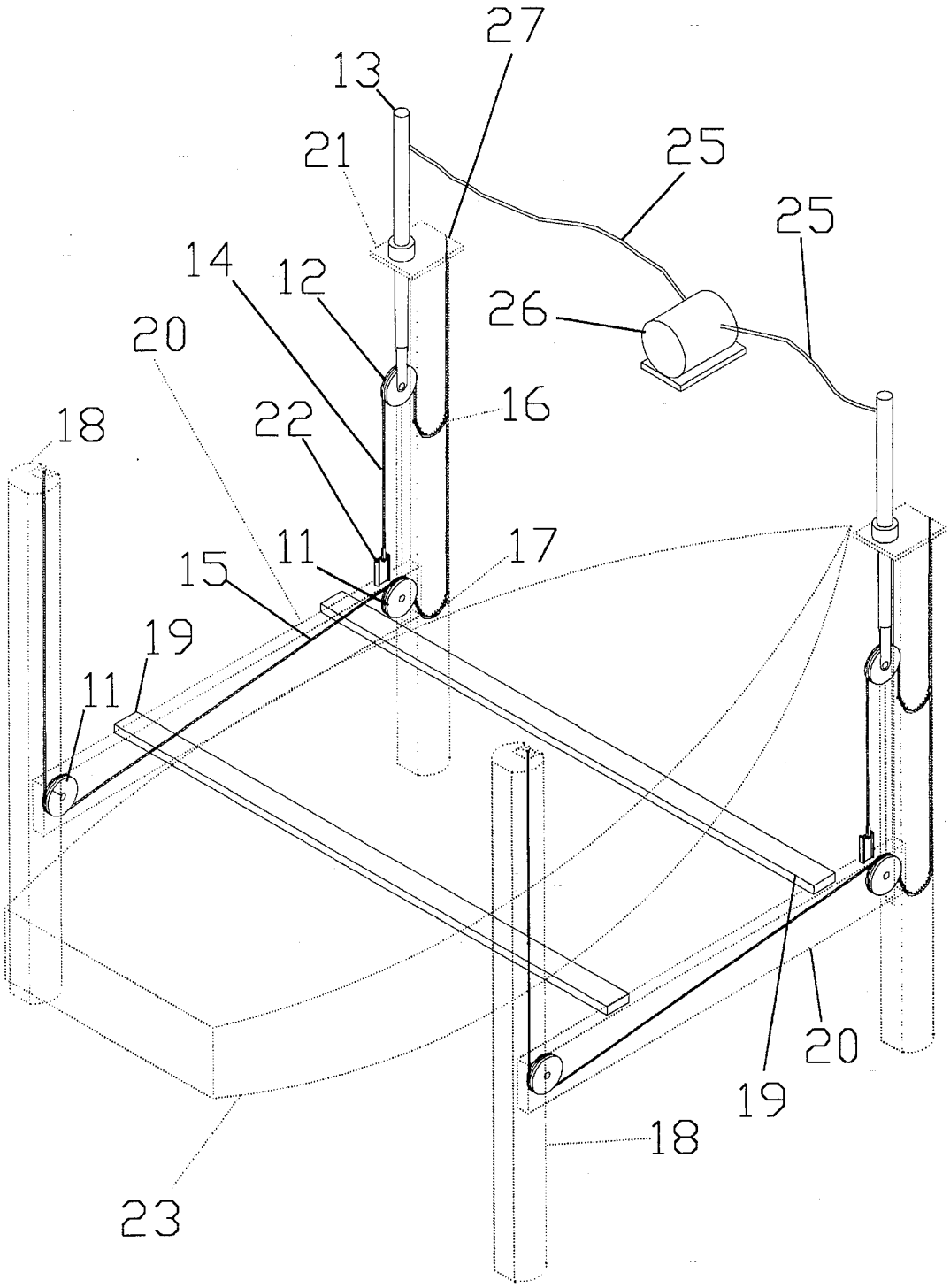
FIG. 1 is a perspective view of a hydraulic boat lift embodying the present invention.
Figure 2:
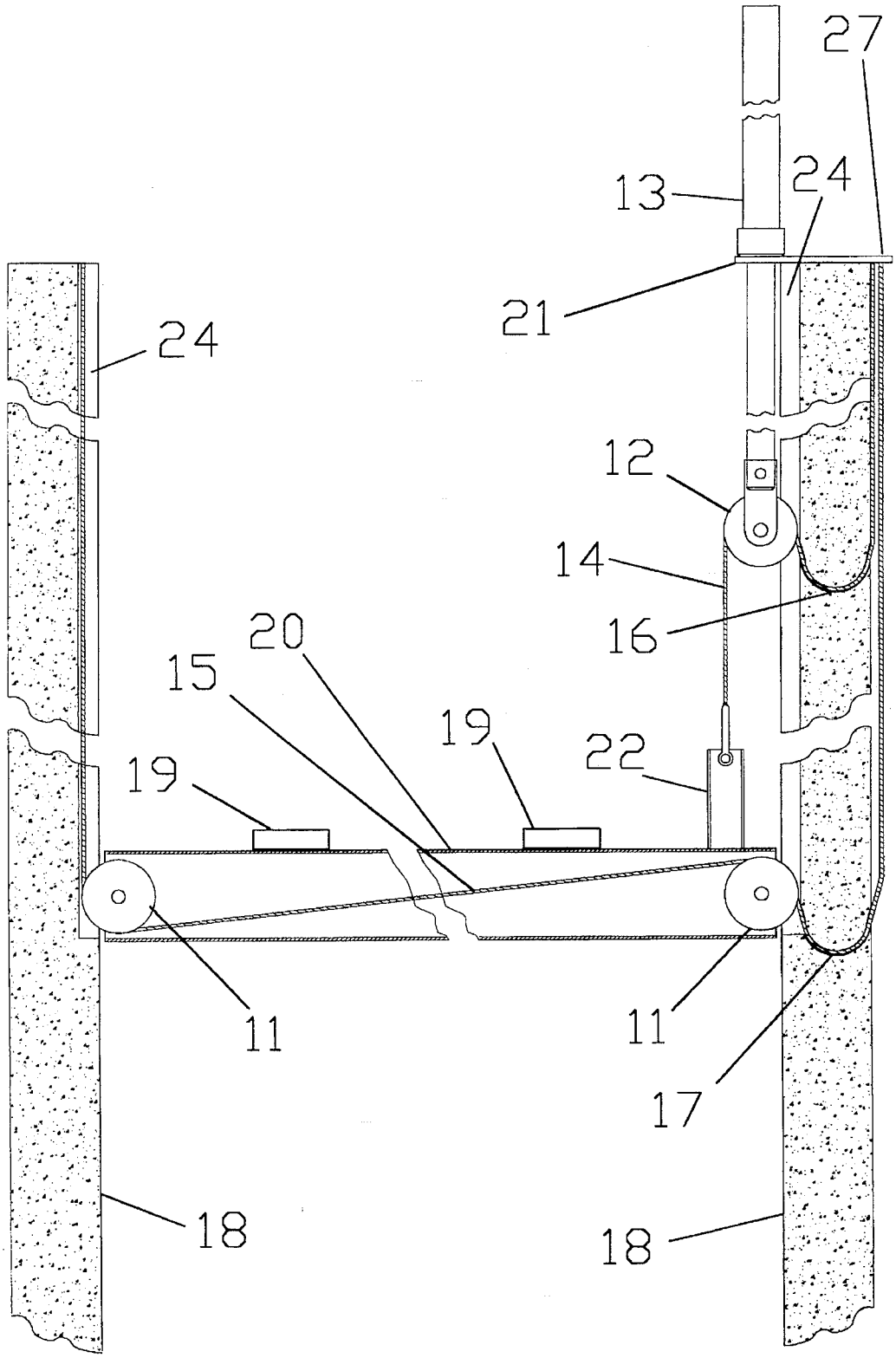
FIG. 2 is a side view, partially in section, of a hydraulic boat lift embodying the present invention.
Figure 5:
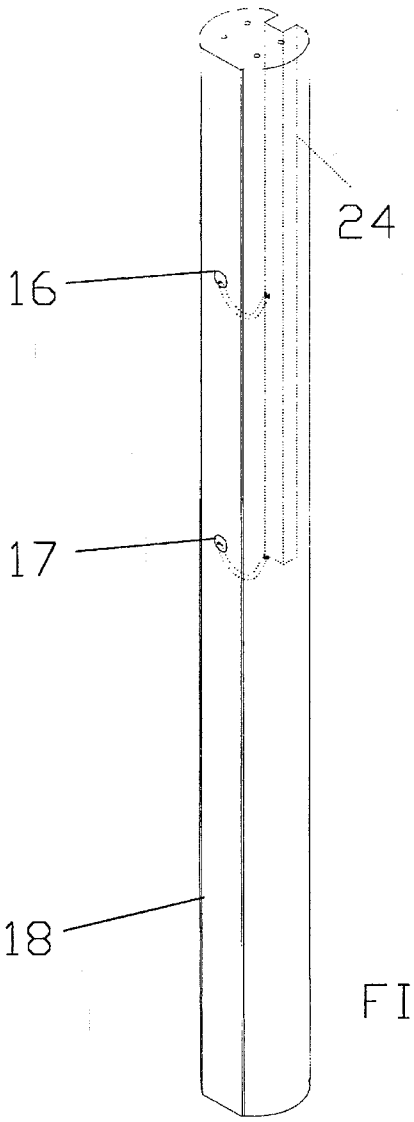
FIG. 5 is a rear perspective view of a piling in accordance with the invention.
Figure 4:
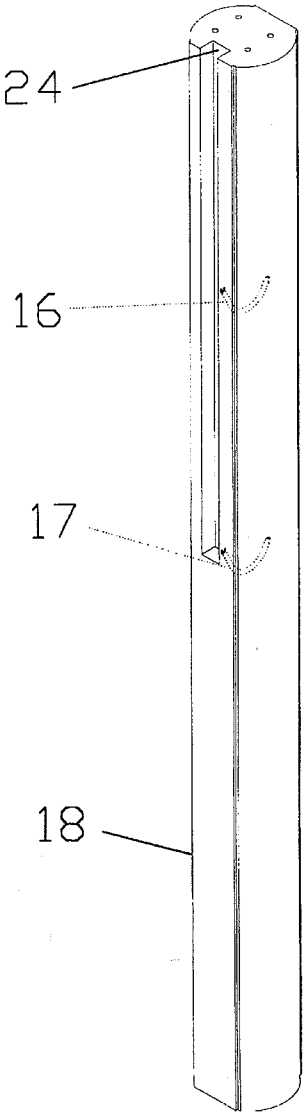
FIG. 4 is a front perspective view of a piling in accordance with the invention.
Figure 3:
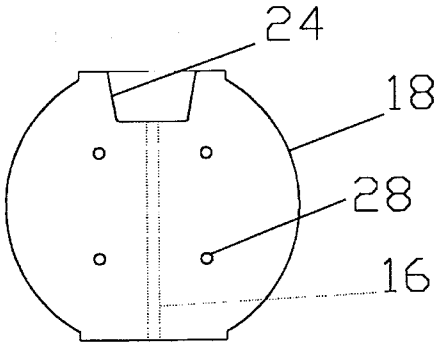
FIG. 3 is a top view of a piling in accordance with the invention.

Referring now particularly to FIGS. 1 and 2, a hydraulic boat lift is shown comprising two pairs of prestressed concrete piles 18 forming four corners of the lift of the invention. The piles 18 are molded in horizontal molds using the process described in related application for Prestressed Concrete piling which is incorporated by reference. The shape of prestressed concrete pile 18 consists of round side surfaces, flat side surfaces and flat ridges. Flexible cable 28 (wire rope) is prestressed and runs through the pile 18 from the bottom surface to the top surface of pile 18. Concertina wire (not shown) is wrapped around the prestressed flexible cables 28 from end to end of the pile 18.

In a preferred embodiment of the hydraulic boat lift of the invention, the top portion of the pile 18 was cast with a groove 24 formed therein starting at the top of the pile 18 to a bottom point determined by the designed vertical movement of the boat lift. In addition, plastic pipes 16 and 17 are cast in the concrete, running from the bottom surface of groove 24 to an outer, flat surface of pile 18. Pipe 16 is located in the top portion, approximately midway between the top of pile 18 and the bottom end of groove 24. Pipe 17 is near the bottom end of groove 24. Pipes 16 and 17 are of sufficient diameter to permit feeding the stainless strand core cables 14 and 15 therethrough. The pipes 16 and 17 are curved downwardly for ease of cable entry and to provide stress free contact with the concrete.

In a preferred embodiment, a typical section consisted of:

SECTION PROPERTIES:

Nominal Pile Size: 10" Round Area: 76.5 in.sq.

Approx. wt/ft=80 lbs S: 107 in.cu.

SPECIFICATIONS:

Concrete: Min. Cylinder Strength at Release=3900 psi

Min. Cylinder Strength at Driving=6000 psi

STEEL:

Strand=⅜" 270 ksi LO-LAX, ASTM A-416 Nominal Area=0.085 in.sq.—Uncoated

Spiral=No. 5 GA. Hard Drawn Wire—Uncoated

STANDARD BUILDING CODE SECTION 1308.3 PRESTRESSED PILES

Section 1308.3.1 Design:fpc=700 psi (MIN.)

Typical Section: 4⅜" Strands fpc=749 (ACTUAL)

Section 1308.3.3 Allow Stress: N (Agfc)=68 Tons

Following is a description of the assembly of the lifting structure in the assembly of one side of the lift and a similar assembly also applies to the opposite side of the lift. The boat lift is assembled by first mounting a hydraulic cylinder 13 to mounting plate 21, fastened to the top of a first pair of piles 18 in a conventional manner. An extra heavy block 12 is affixed to each of the hydraulic cylinders 13 and is adapted to run vertically in groove 24 of pile 18.

Stainless strand core cables 14 and 15 are affixed to mounting plates 21 at a first end and cable 14 is then run through pipes 16 in piles 18. Cables 14 are then run through blocks 12 and affixed to lifting brackets 22. Lifting brackets 22 are each affixed to a first end of structural tubing 20. In a preferred embodiment, cables 14 were ⅜" 7×19 stainless strand core cable. Hydraulic cylinders 13 are powered by hydraulic pump 26 which provides hydraulic fluid through hydraulic tubing 25.

Structural tubing 20 provides the basic lifting means for boat supports 19 affixed thereto. Several different conventional boat mounts (not shown) may be affixed to boat supports 19 dependent upon the shape of the keel and bottom of the boat to be supported. Pivotally fastened to structural tubing 20 are extra heavy duty blocks 11, a block at each end of tubing 20. The basic lifting means comprises the pair of structural tubing 20 lengths with the boat supports 19 affixed thereto to form a platform. The four blocks 11 are then aligned within the vertical grooves 24 of piles 18. In operation, the blocks 11 bear against the bottom surface of grooves 24 and roll up and down as the lift is actuated. In a preferred embodiment the blocks 11 were 6" in diameter. The blocks 11 are mounted inside the structural tubing 20 at each end and extend a sufficient distance from the ends of tubing 20 to bear against the bottom of groove 24 when assembled.

The free ends of cable 15 are then run through pipes 17 and over the tops of block 11 near the lifting brackets 22, through the tubing 20 and under the blocks 11 located at the ends of tubing 20 opposite the ends having lifting brackets 22. Cables 15 are then fastened to the tops of a second pair of piles 18, located opposite the first pair of piles 18 having the cylinders 13.

The instant invention is a basic assembly of hydraulic power and the mechanical advantage obtained by the use of cables and blocks assembled in a unique manner. With the hydraulic cylinders 13 located at one end of the boat lift, and the unique assembly of the piles, cables, and blocks, the lifting distance of the hydraulic boat lift of the invention is magnified by a factor of 2:1 and is only limited by the size and power of the hydraulic cylinders selected.

Following is a description of the operation of the lifting structure of one side of the lift and a similar operation applies to the opposite side of the lift. Referring to FIG. 2, a first lifting cable 14 is shown attached to plate 21, as at point 27. Cable 14 is run downwardly and through pipe 16, over block 12 at the end of cylinder 13, and downwardly where it is attached to lift bracket 22. When pressure is applied to cylinder 13, block 12 pulls upwardly against the cable 14 and thereby lifts a first end of the boat lift. A second lifting cable 15 is also attached to plate 21, as at point 27. Cable 15 is run downwardly and through pipe 17, over first block 11, through the tubing 20, under second block 11 and up to the top of pile 18 where it is fastened. As the boat lift rises, the block 11 begins to pull the horizontal portion of cable 15 which in turn pulls the cable 15 wrapped under block 11 and the second end of tubing 20 is lifted as the cable winds under block 11. The blocks 11 are guided in their vertical paths by grooves 24.

The lifting distance of the instant invention is determined by the range of tide available in any area. The size of the hydraulic cylinder and its distance of travel will be determined by the weight and size of the boat intended to be lifted. The unique arrangement of the instant invention provides a mechanical advantage not currently available on the market.

The principles, preferred embodiments and modes of operation of the present invention have been described in the foregoing specification. The invention which is intended to be protected herein, however, is not to be construed as limited to the particular embodiments disclosed, since these embodiments are to be regarded as illustrative rather than restrictive. Variations and changes may be made by others without departing from the spirit of the invention. Accordingly, it is expressly intended that all such variations and changes which fall within the spirit and scope of the claims be embraced thereby.

What is claimed is:

1. A hydraulic boat lift for raising and lowering a boat relative to a surface of a body of water, comprising:

a first and a second pair of prestressed concrete piles forming the four corners of the lift, each of said piles having a top, a top portion, two round outer surfaces and a first and second flat outer surfaces, a vertical groove formed in each of said piles, at said top portion in said first flat surface from said top to a point forming a bottom end limit of travel of the lift, a first pipe molded in said first pair of piles at a point midway in said vertical groove, through said piles and said second flat surfaces, a second pipe molded in said first pair of piles at a bottom end of said groove, through said piles and said second flat surfaces, a pair of lifting means suspended between said first and second pairs of piles, said lifting means each having a first and second end and a lifting bracket at said first end near said first pair of piles and a block pivotally mounted at each of said first and second ends, said blocks being aligned within said vertical grooves and bearing against said piles a hydraulic cylinder mounted vertically on top of each of said piles of said first pair of piles, said cylinders having a block aligned within said grooves, a first pair of cables, each having a first end and a second end, each of said first ends affixed to a respective pile top of said first pair of piles, run through said first pipe in each of said pairs of piles, run over said cylinder blocks, and attached to said lifting brackets, a second pair of cables, each having a first end and a second end, each of said first ends affixed to a respective pile top of said first pair of piles, run through said second pipe in each of said pairs of piles, run over a block pivotally mounted on said first end of said lifting means, through said lifting means, and under a block pivotally mounted on said second end of said lifting means, run up through said vertical grooves in each of said piles in said second pair of piles, and affixed to said tops of each of said second pair of said piles, and hydraulic pressure means connected to each of said hydraulic cylinders for providing lifting pressures whereby the boat lift is lowered or raised when the pressure means are activated as needed.

2. A prestressed concrete pile for a hydraulic boat lift, said pile comprising:

steel reinforcing means including four, prestressed cables running through the entire length, and spaced around the center of said pile to form a square shape relationship to each other, a concrete mixture embedding said reinforcing means and forming a top and bottom surface, a top portion, two round side surfaces, and a first and second flat side surface, a vertical groove formed at said top portion in said first flat side surface from said top to a point forming a bottom end limit of travel of the lift, a first pipe molded in said pile at a point midway in said vertical groove, through said pile and said second flat side surface, and a second pipe molded in said pile at a bottom end of said groove, through said pile and said second flat surface.

* * * * *